US008143809B2

(12) United States Patent
Yamazaki et al.

(10) Patent No.: US 8,143,809 B2
(45) Date of Patent: Mar. 27, 2012

(54) LED ILLUMINATING DEVICE

(75) Inventors: Shigeaki Yamazaki, Osaka (JP); Hiroyuki Sako, Osaka (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 450 days.

(21) Appl. No.: 12/490,556

(22) Filed: Jun. 24, 2009

(65) Prior Publication Data

US 2010/0019691 A1 Jan. 28, 2010

(30) Foreign Application Priority Data

Jun. 24, 2008 (JP) ..... 2008-165056

(51) Int. Cl.
*H05B 37/02* (2006.01)

(52) U.S. Cl. ..... 315/294; 315/317

(58) Field of Classification Search ..... 315/291, 315/294, 297, 307, 317; 345/84, 87, 88
See application file for complete search history.

(56) References Cited

U.S. PATENT DOCUMENTS 7,319,298 B2 * 1/2008 Jungwirth et al. ..... 315/307
7,615,939 B2 * 11/2009 Halter ..... 315/307
7,990,360 B2 * 8/2011 Song et al. ..... 345/102
2008/0180414 A1 * 7/2008 Fung et al. ..... 345/204
2009/0231354 A1 * 9/2009 Blaut et al. ..... 345/589
2009/0289965 A1 * 11/2009 Kurokawa et al. ..... 345/690
2010/0277498 A1 * 11/2010 Elliott et al. ..... 345/589

FOREIGN PATENT DOCUMENTS

JP 2001093305 4/2001

* cited by examiner

*Primary Examiner* — Don Le

(74) *Attorney, Agent, or Firm* — Waddey & Patterson, P.C.; Mark J. Patterson

(57) ABSTRACT

A LED illuminating device includes: a power source device, a controller, an LED lighting device, and an LED unit 4 incorporating LEDs of a plurality of emission colors. The device is configured to mix the lights of the LEDs at an arbitrary proportion and set the lights in an arbitrary color mixture proportion on the basis of a dimming signal from the controller. The device is further configured so that: a coefficient specific to the LED unit at which an emission color of the LED unit becomes a desired color can be set to a signal value of the controller preliminarily set as a standard. The LED lighting device can control an emission amount of the LEDs having the respective emission colors by using a value calculated by a calculation expression employing the specific coefficient.

7 Claims, 10 Drawing Sheets

LED ILLUMINATING DEVICE

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application which is hereby incorporated by reference: Japanese Patent Application No. JP2008-165056 filed Jun. 24, 2008.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates to a LED illuminating device that employs a plurality of LEDs emitting different light colors as a light source and that has a function for changing a light color by dimming each of the LEDs.

Japanese Unexamined Patent Publication No. 2001-93305 discloses a conventional LED illuminating device. This device includes a plurality of LED light sources; a plurality of light guides into which a light from each of the LED light sources is guided; and a control device for controlling each of the LED light sources, and emits a light of arbitrary color through an individual control of lighting states of the respective LED light sources by the control device.

However, a conventional LED illuminating device has a problem where a consistent color cannot be obtained because of an uneven luminance of the LEDs and unevenness of emission colors of the LEDs themselves, even in a case of lighting a plurality of LED illuminating devices in a same lighting state.

BRIEF SUMMARY OF THE INVENTION

An object of the present invention is to provide, at a low cost, a LED illuminating device that reduces unevenness of the color even when the luminance of the LEDs are uneven and the emission colors of the LEDs themselves are uneven. To solve the above-mentioned problems, an LED illuminating device of the present invention includes a power source device, a controller, an LED lighting device, and an LED unit 4 incorporating LEDs of a plurality of emission colors. The device is configured to mix the lights of the LEDs in an arbitrary proportion and set the lights in an arbitrary color mixture proportion on the basis of a dimming signal from the controller. The LED illuminating device is configured so that: a coefficient specific to the LED unit at which an emission color of the LED unit becomes a desired color can be set to a signal value of the controller preliminarily set as a standard. The LED lighting device can control an emission amount of the LEDs having the respective emission colors by using a value calculated by a calculation expression employing the specific coefficient.

According to the present invention, the invention is configured so that a coefficient specified to a LED unit at which an emission color of the LED unit becomes a desired color can be set to a signal value of the controller preliminarily set as a standard. The LED lighting device can adjust an emission amount of the LEDs of respective emission colors by using a value calculated from the specific coefficient. Thus, an LED illuminating device having a small color unevenness between the respective devices regardless of unevenness of luminance of the LEDs and emission colors of LEDs themselves can be provided.

DETAILED DESCRIPTION OF THE INVENTION

Figure 1:
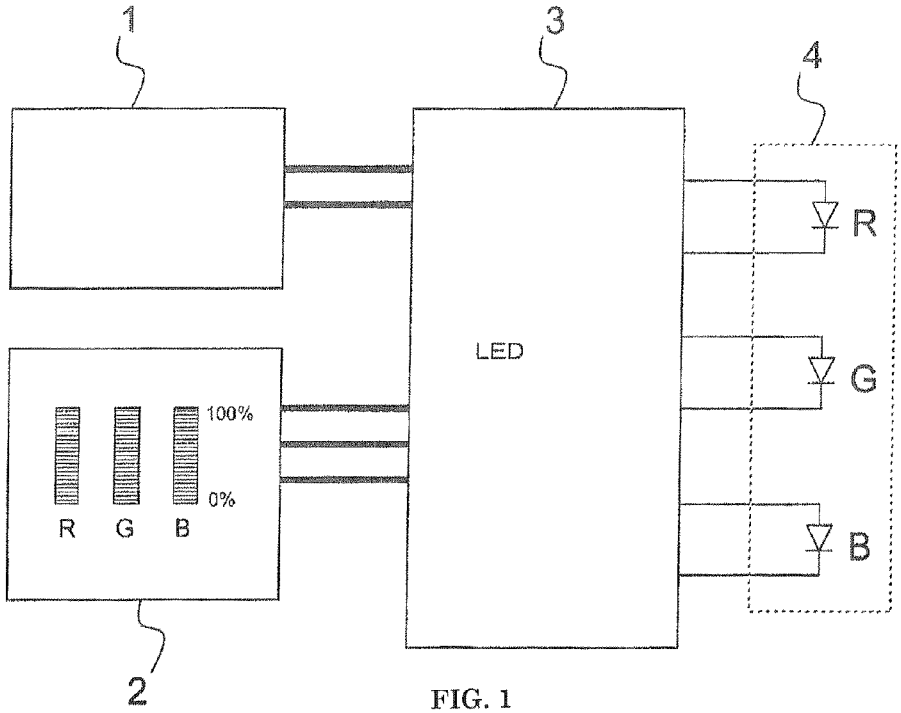
FIG. 1 is a block diagram of a first embodiment of the present invention.

FIG. 1 shows a first embodiment of the present invention. A LED illuminating device according to the present embodiment includes a power supply device 1, a controller 2, a LED lighting device 3, and a LED unit 4. The LED unit 4 includes LEDs of emission colors, red (R), green (G), and blue (B), and is able to emit light in various colors by adequately changing an emission intensity of each of LEDs R, G, and B.

The power supply device 1 is a power supply for driving the LED lighting device, the power supply being supplied at, for example, DC 30V. The controller 2 includes three sliding volume faders red (R), green (G), and blue (B). Outputs of the controller 2 are connected to the LED lighting device 3, and are configured so as to transmit positional scale information of the respective volume faders R, G, and B to the LED lighting device 3. The positional scale information of the respective volume faders are shown as fR, fG, and fB, and a minimum value of their possible values is 0 and a maximum value is 1. The LED lighting device 3 changes a lighting state of the LED unit 4 on the basis of the positional scale information of the volume faders from the controller 2. Luminance of the LEDs controlled by the LED lighting device 3 are shown as ϕR, ϕG, and ϕB, and a minimum value of their possible values is 0 and a maximum value is 1.

Now, regarding certain LED unit 4, it is assumed that the luminance ϕR, ϕG, and ϕB at which the white (for example, X=0.281 and Y=0.287 in the chromaticity coordinates) and a maximum emission intensity is obtained by adjusting the LED lighting device 3 are ϕR0, ϕG0, and ϕB0, respectively.

Here, consider the following coefficients kR, kG, and kB, $$kR=\phi R0,$$

$$kG=\phi G0, \text{ and}$$

$$kB=\phi B0.$$

And, the LED lighting device 3 is configured to be controlled in accordance with following expressions, $$\phi R=kR\times fR,$$

$$\phi G=kG\times fG, \text{ and}$$

$$\phi B=kB\times fB.$$

Due to the lighting control carried out in the above-mentioned manner, the white color can be certainly reproduced when fR, fG, and fB are equal to 1. In the similar manner, another LED unit 4 also can be lighted in the white color by obtaining other kR, kG, and kB (coefficients specific to the LED unit).

TABLE 1

| | Light source 1 (R) | Light source 2 (G) | Light source 3 (B) |
|---|---|---|---|
| Chromaticity x of light source | 0.6850 | 0.1900 | 0.1300 |
| Chromaticity y of light source | 0.3050 | 0.6900 | 0.0750 |
| Chromaticity z of light source | 20.00 | 30.00 | 10.00 |

kR = 0.6408, kG = 1.0000, and kB = 0.6467

TABLE 2

| | Light source 1 (R) | Light source 2 (G) | Light source 3 (B) |
|---|---|---|---|
| Chromaticity x of light source | 0.6850 | 0.1900 | 0.1370 |
| Chromaticity y of light source | 0.3050 | 0.6900 | 0.0370 |
| Chromaticity z of light source | 20.00 | 30.00 | 10.00 |

kR = 0.5443, kG = 1.0000, and kB = 0.2688

Figure 2:
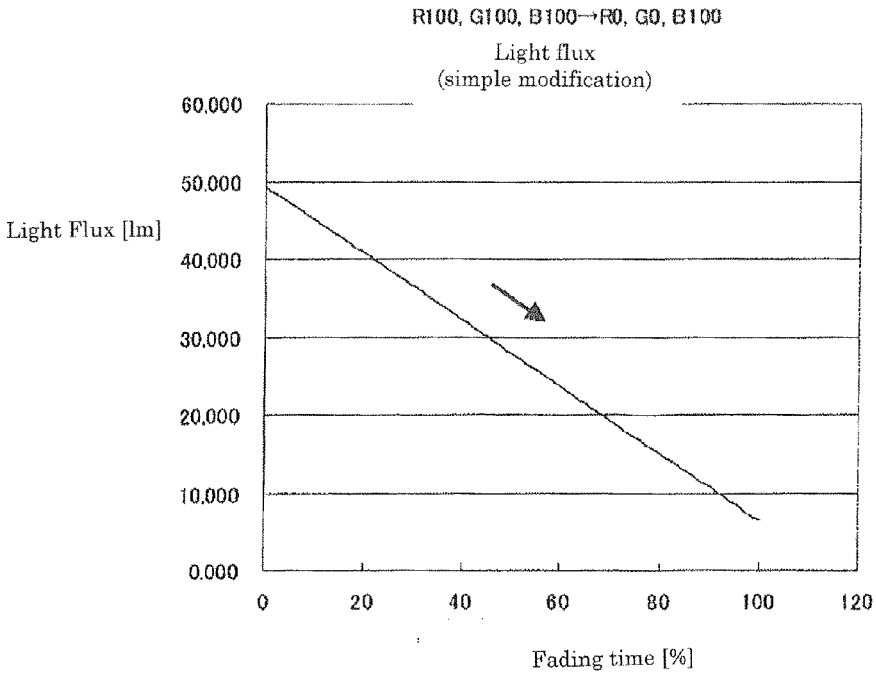
FIG. 2 is a graphic representation a synthetic light flux according to the first embodiment of the present invention.
Figure 3:
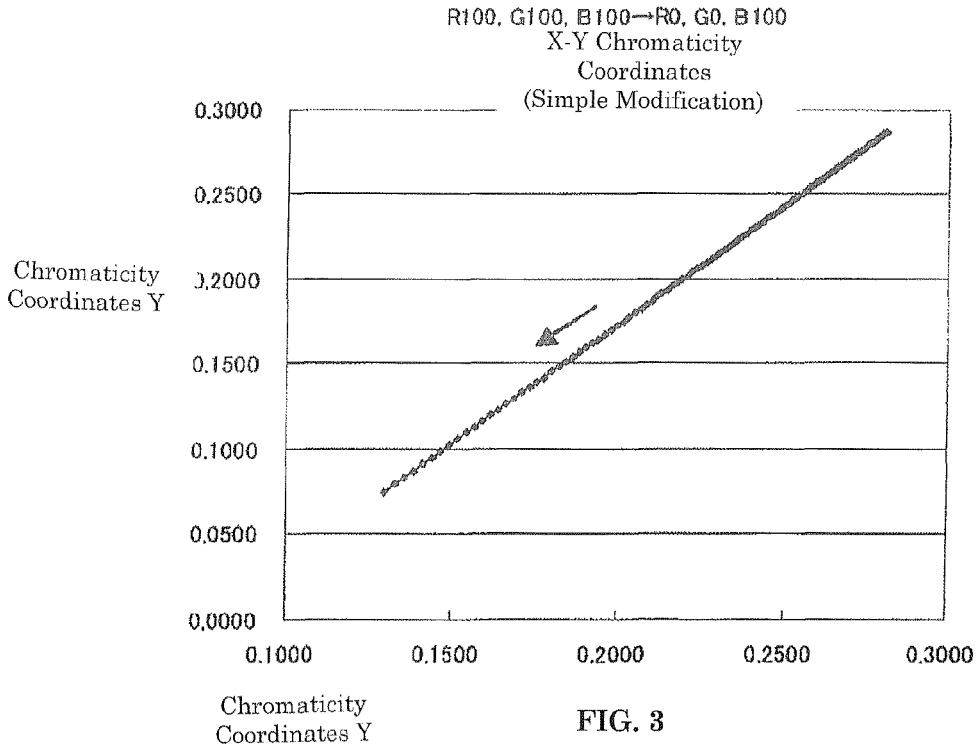
FIG. 3 is graphic representation showing a synthetic chromaticity according to the first embodiment of the present invention.
Figure 4:
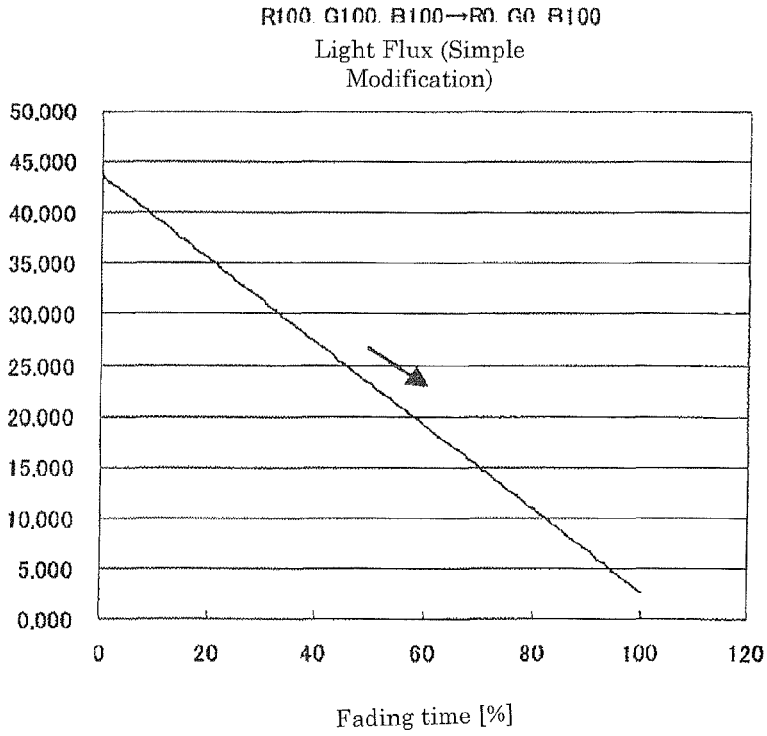
FIG. 4 is graphic representation showing the synthetic light flux according to the first embodiment of the present invention.
Figure 5:
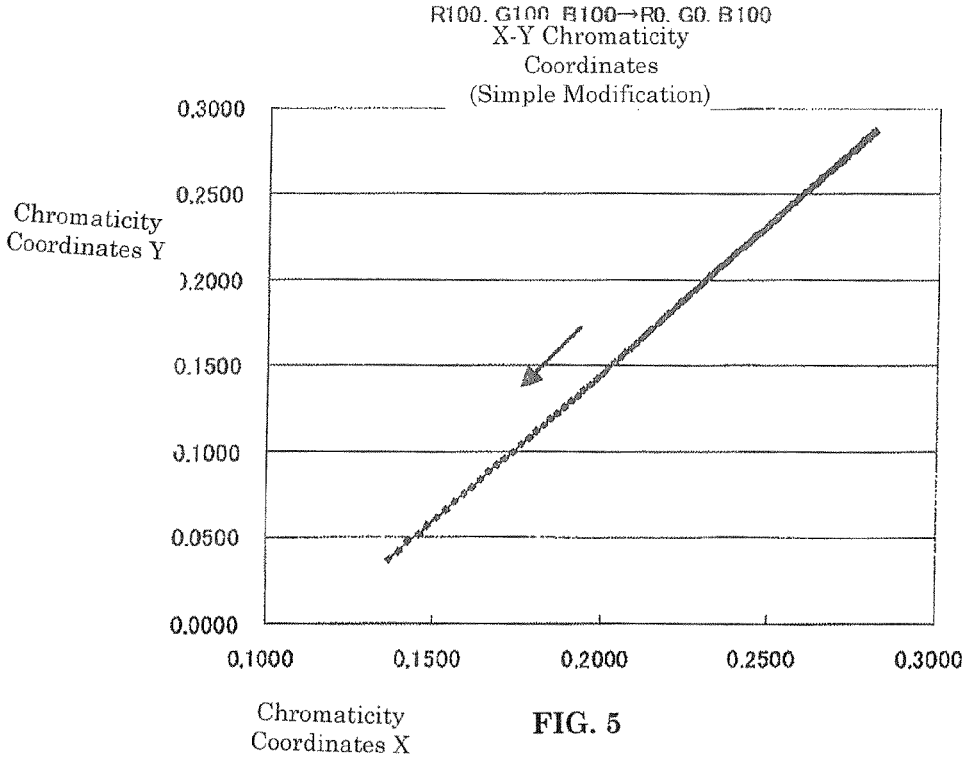
FIG. 5 is a graphic representation showing the synthetic chromaticity according to the first embodiment of the present invention.

FIGS. 2 and 3 show graphs obtained by calculating a synthetic light flux and a synthetic chromaticity in operating the volume faders in a case where unevenness of the respective LEDs show the values of the table 1. In addition, FIGS. 4 and 5 show graphs obtained by calculating the synthetic light flux and the synthetic chromaticity in operating the volume faders in a case where the unevenness of the respective LEDs show the values of the table 2. In FIGS. 2 to 5, it is assumed that the values of the volume faders in each case linearly change from fR=1.00, fG=1.00, and fB=1.00 to fR=0.00, fG=0.00, and fB=1.00.

Comparing FIG. 3 with FIG. 5, it can be found that the chromaticity coordinates of a single color after the fading show different colors because of the unevenness of each LED. However, the chromaticity coordinates at the beginning of the fading are X=0.281 and Y=0.287 to show the same color.

According to the present embodiment, since the device is configured to employ values obtained by multiplying indication values fR, fG, and fB of the volume faders of the controller 2 by the preliminarily-set constants kR, kG, and kB specific to the LED unit 4 as the lighting control values ϕR, ϕG, and ϕB of each LED, the low-cost LED illuminating device that reduces the color unevenness between the illumination devices despite unevenness of the LED unit 4 can be provided.

Meanwhile, the output voltage of the power supply device 1 is DC 30V in one embodiment. However, other DC voltages and AC voltages may be employed. Information may be transmitted from the controller 2 to the LED lighting device 3 by a digital signal (the DMX signal, the PNM signal, and the like) and may be an analog signal (the DC voltage, the PWM signal, and the like). The lighting control circuitry in the LED lighting device 3 may control the lighting by changing a current passing through a LED load; and changing the duty of a pulsed load current. In addition, a technical concept of the present invention can be arbitrarily applied if applied to light sources of different colors, and can provide the same effect also to unevenness of light sources such as an organic EL, laser light, and an incandescent light through filter. It is the same with each embodiment.

A configuration according to a second embodiment of the present invention is the configuration of FIG. 1, similar to that of the first embodiment. However, the lighting control of the LED lighting device 3 is controlled on the basis of following expressions.

$$\phi R=fR\times(kR+(1-\max(fG,fB))\times(1-kR))$$

$$\phi G=fG\times(kG+(1-\max(fB,fR))\times(1-kG))$$

$$\phi B=fB\times(kB+(1-\max(fR,fG))\times(1-kB))$$

Here, the max(a, b) is a function for showing the larger value, a or b.

Figure 6:
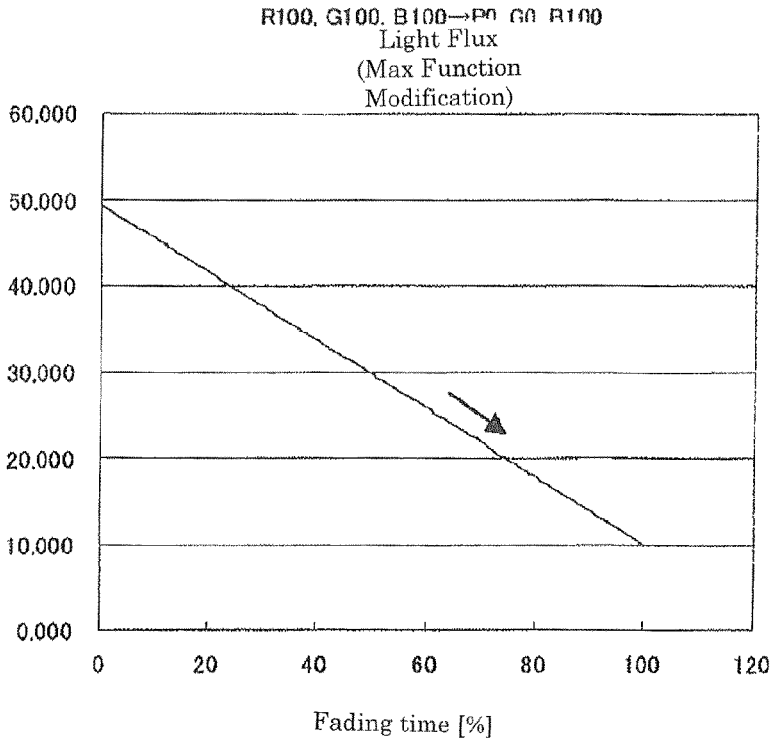
FIG. 6 is a graphic representation showing a synthetic light flux according to a second embodiment of the present invention.
Figure 7:
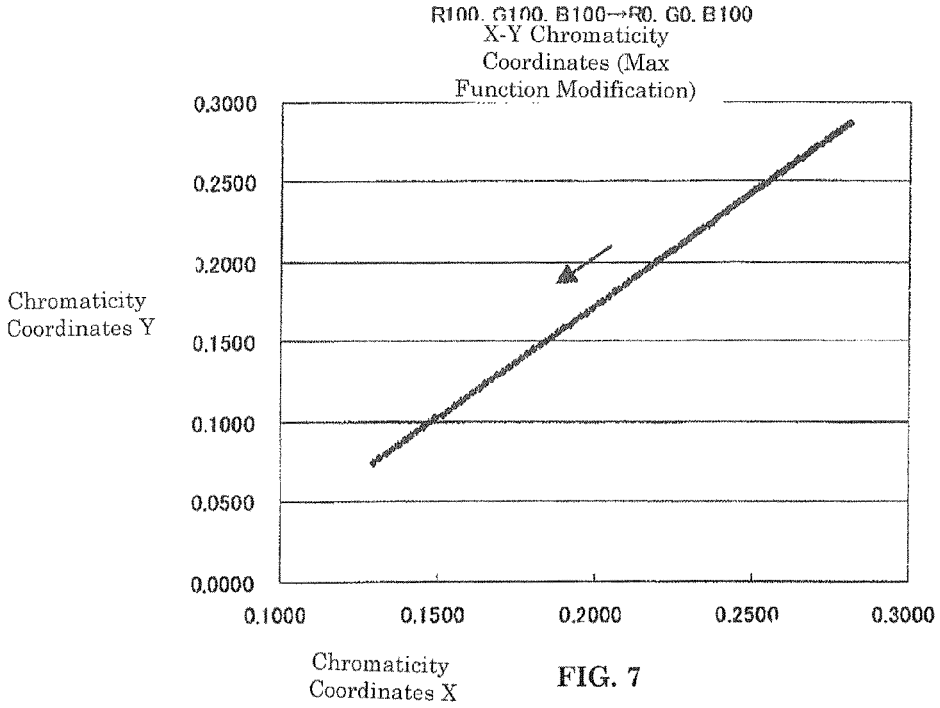
FIG. 7 is a graphic representation showing a synthetic chromaticity according to the second embodiment of the present invention.

FIGS. 6 and 7 show graphs obtained, in a case of employing the control method, by calculating a synthetic light flux and a synthetic chromaticity in operating the volume faders in a case where unevenness of the respective LEDs show the values of Table 1. In FIGS. 6 and 7, it is assumed that the values of the volume faders linearly change from fR=1.00, fG=1.00, and fB=1.00 to fR=0.00, fG=0.00, and fB=1.00.

Comparing FIG. 6 with FIG. 2, it can be found that there is a difference between the light fluxes when a fading time reaches a rate of 100%. The light flux of FIG. 6 according to the present embodiment is higher than the other one, and accordingly it is found that a performance of the LED can be sufficiently given. Additionally, according to comparison of FIG. 3 with FIG. 7, it can be confirmed that there is no difference in a chromaticity range that can be reproduced.

Figure 8:
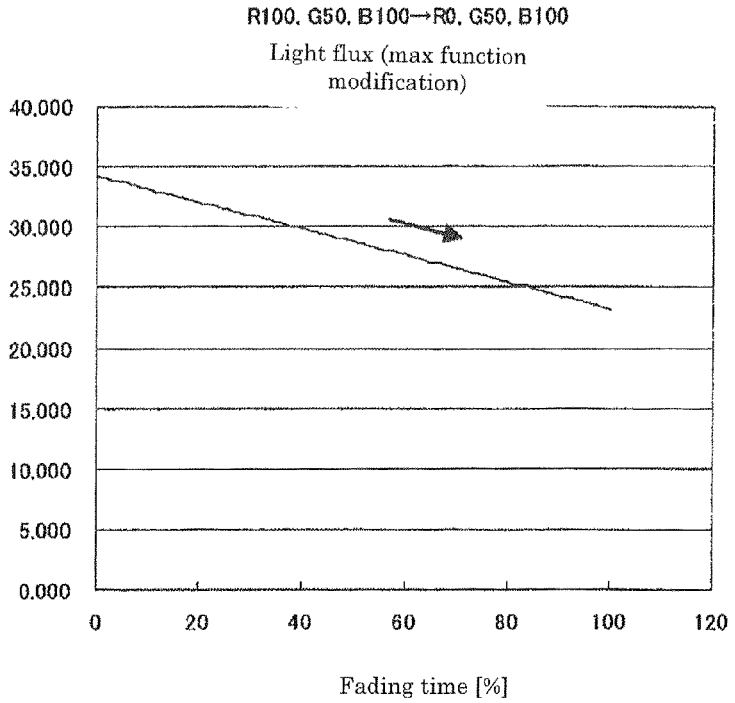
FIG. 8 is a graphic representation showing the synthetic light flux according to the second embodiment of the present invention.
Figure 9:
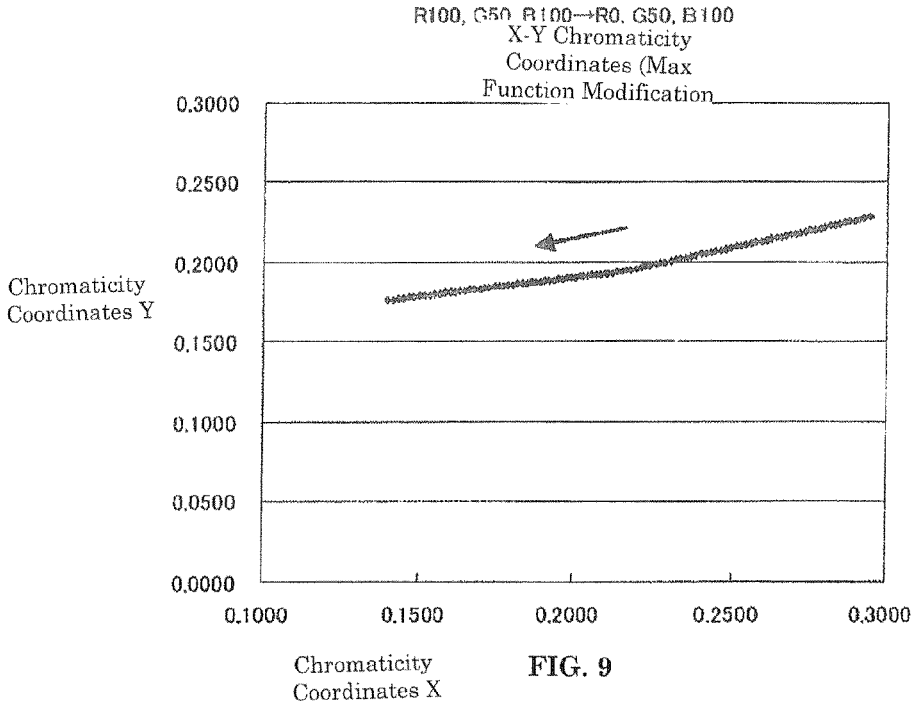
FIG. 9 is a graphic representation showing the synthetic chromaticity according to the second embodiment of the present invention.

FIGS. 8 and 9 show graphs obtained by calculating a synthetic light flux and a synthetic chromaticity in a pattern of different operation of the volume faders in a case where unevenness of the respective LEDs show the values of Table 1. In FIGS. 8 and 9, it is assumed that the values of the volume faders linearly change from fR=1.00, fG=0.50, and fB=1.00 to fR=0.00, fG=0.50, and fB=1.00.

According to the present embodiment, the device is configured to calculate an amount of the light flux to be outputted according to the above-mentioned calculation expressions by using values obtained by multiplying indication values of the volume faders of the controller by the preliminarily-set constants specific to the LED unit, and to employ the amount as a lighting control value of the LED. Accordingly, a low-cost LED illuminating device that reduces the color unevenness between different illumination devices despite unevenness of the LED unit 4 can be provided. Additionally, in the present embodiment, the coefficient multiplied by the indication value of the volume fader is 1 in a case of setting the volume fader to be a single color, and thus the device is configured not to lower the light flux of the single color even when the LED is uneven.

A configuration according to a third embodiment of the present invention is the configuration of FIG. 1, similar to that of first embodiment. However, the lighting control of the LED lighting device 3 is controlled on the basis of the following expressions.

$$\phi R=fR\times(kR+(1-fG)\times(1-fB)\times(1-kR))$$

$$\phi G=fG\times(kG+(1-fB)\times(1-fR)\times(1-kG))$$

$$\phi B=fB\times(kB+(1-fR)\times(1-fG)\times(1-kB))$$

Figure 10:
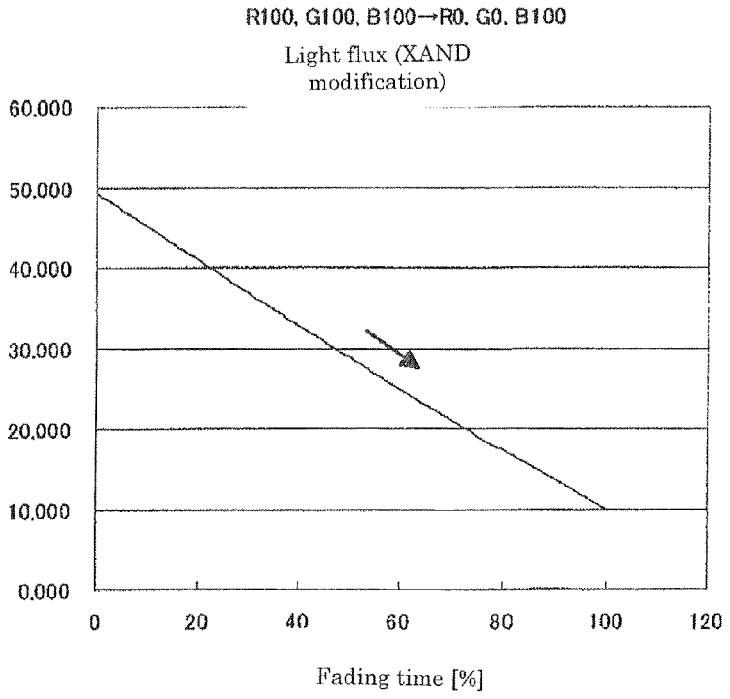
FIG. 10 is a graphic representation showing a synthetic light flux according to a third embodiment of the present invention.
Figure 11:
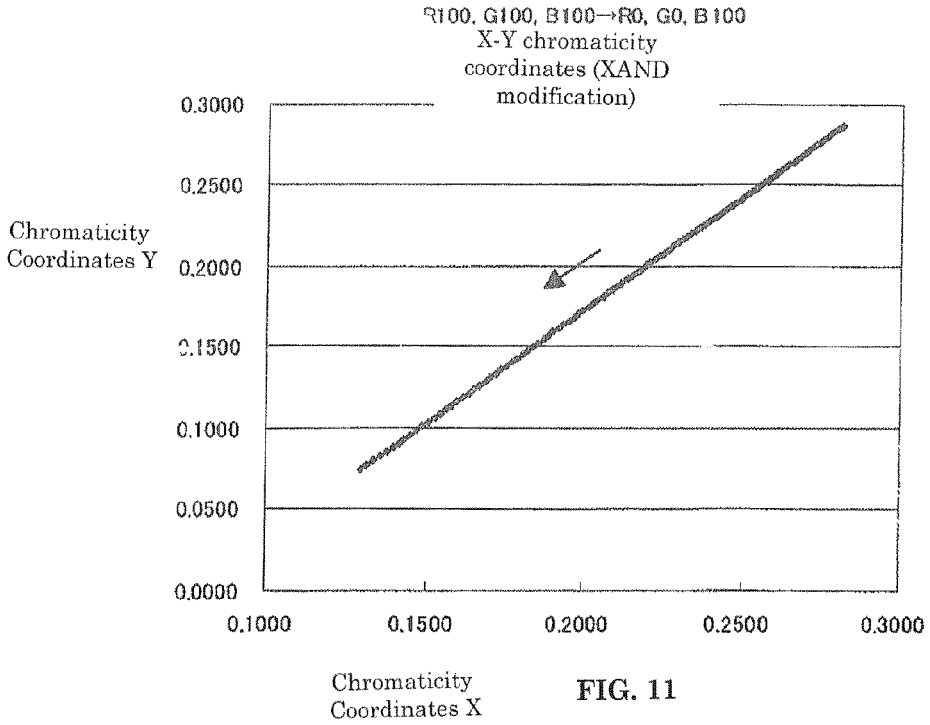
FIG. 11 is a graphic representation view showing a synthetic chromaticity according to the third embodiment of the present invention.

FIG. 10 and FIG. 11 show graphs obtained, in the case of employing the control method, by calculating a synthetic light flux and a synthetic chromaticity in operating the volume faders in a case where unevenness of the respective LEDs show the values of Table 1. In FIGS. 10 and 11, it is assumed that the values of the volume faders linearly change from fR=1.00, fG=1.00, and fB=1.00 to fR=0.00, fG=0.00, and fB=1.00.

Comparing FIG. 10 with FIG. 2, it can be found that there is a difference between the light fluxes when the fading time reaches a rate of 100%. The light flux of FIG. 10 according to the present embodiment is higher than the other one, and accordingly it is found that a performance of the LED can be sufficiently given. Additionally, according to comparison of FIG. 3 with FIG. 11, it can be confirmed that there is no difference in a chromaticity range that can be reproduced.

Figure 12:
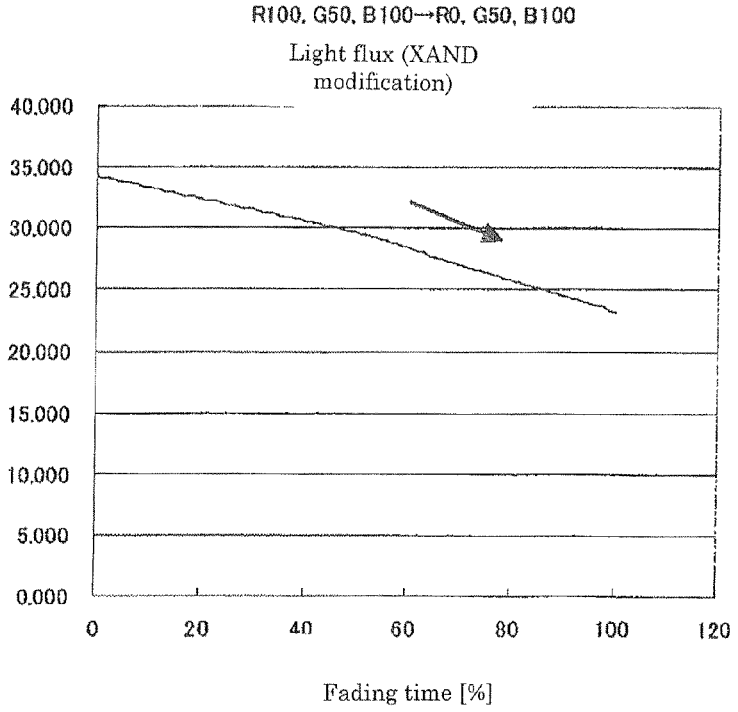
FIG. 12 is a graphic representation showing the synthetic light flux according to the third embodiment of the present invention
Figure 13:
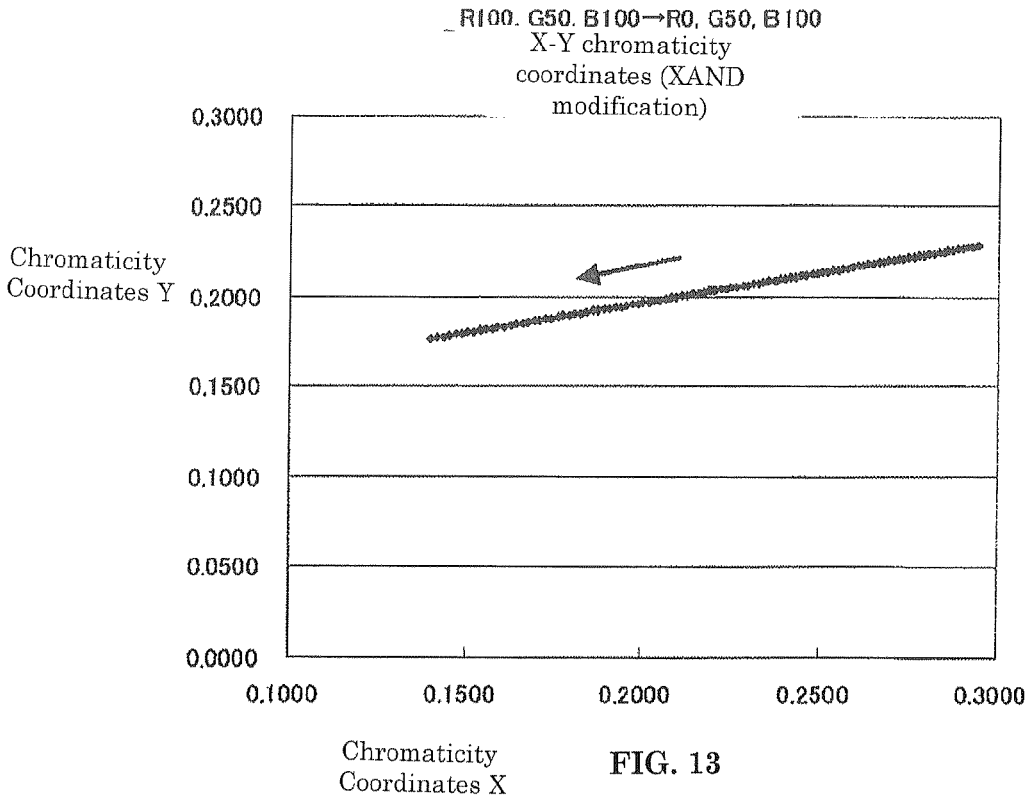
FIG. 13 is a graphic representation showing the synthetic chromaticity according to the third embodiment of the present invention.

FIGS. 12 and 13 show graphs obtained by calculating a synthetic light flux and a synthetic chromaticity in a pattern of different operation of the volume faders in a case where unevenness of the respective LEDs show the values of Table 1. In FIGS. 12 and 13, it is assumed that the values of the volume faders linearly change from fR=1.00, fG=0.50, and fB=1.00 to fR=0.00, fG=0.50, and fB=1.00.

Comparing FIG. 8 with FIG. 12 and comparing FIG. 9 with FIG. 13, a bending point is generated in the fading period in FIGS. 8 and 9, however, the bending point is not generated in FIGS. 12 and 13. Accordingly, as compared to the second embodiment, the present embodiment has advantages that allow an intuitive operation for adjustment of the volume fader to facilitate a color matching.

According to the present embodiment, the device is configured to calculate an amount of the light flux to be outputted according to the above-mentioned calculation expressions by using values obtained by multiplying indication values of the volume faders of the controller by the preliminarily-set constants specific to the LED load, and to employ the amount as the lighting control value of the LED. Accordingly, a low-cost LED illuminating device that reduces the color unevenness between the illumination devices despite unevenness of the LED load can be provided. In the present embodiment, the coefficient multiplied by the indication value of the volume fader is 1 in a case of setting the volume fader to be a single color, and thus the device is configured not to lower the light flux of the single color even when the LED is uneven. In addition, since the characteristic has no changing point in operation of the volume fader and linearly changes, an intuitive operation is realized.

Meanwhile, to simplify the description, a relationship between the operation of the volume fader and a fading time is described as a proportional relationship in the graph of the present embodiment, and a non-linear specific function (the Munsell curve, a 2.3th power curve, and the like) of time is generally used to smooth an appearance of light. However, when any relationship is employed as the relationship between the volume fader and the time, a same effect can be obtained regardless of a way of thinking of the present invention, and when there is no relationship between an actual operation amount of the volume fader and a value of the volume fader, a same effect can be obtained.

In addition, a LED component mounting LEDs of three colors, RGB, in a single 3-in-1 package exists, and, in the LED, a current value able to flow when the LED is lighted in a single color is different from a current value able to flow when the three colors of RGB are lighted at the same time. In that case, when the current value of the LED is adjusted according to the following expressions by using the luminance values $\phi R$, $\phi G$, and $\phi B$ of the LEDs obtained by the calculation expressions of the above-mentioned embodiments, the light is naturally-dimmed in both of the light flux and the chromaticity.

$$IR=IR0\times A\times\phi R(\phi R+(\phi G+\phi B)$$

$$IG=IG0\times A\times\phi G(\phi R+(\phi G+\phi B)$$

$$IB=IB0\times A\times\phi B(\phi R+\phi G+\phi B)$$

$$A=1-(1-\phi R)\times(1-\phi G)\times(1-\phi B)$$

In the above-mentioned expressions, IR0, IG0, and IB0 represent electric currents passing through each of the LEDs of R, G, and B to output ϕR, ϕG, and ϕB, respectively, and IR, IG, and IB represent current values adjusted for the 3-in-1 LED.

It is now apparent to those of skill in the art that the present invention can be applied to an LED illumination device including an LED unit having four types of light colors.

FIGS. 14 to 18 show schematic configurations of LED illuminating devices according to a fourth embodiment of the present invention. In the present embodiment, in the case where a plurality of the LED illuminating devices are controlled, a subtle color matching can be carried out by a mechanistic operation to realize a control for reducing unevenness of colors between the LED illuminating devices.

In the first, second, and third embodiments, the light colors are adjusted by changing current values of the respective LEDs of R, G, and B. In the case where the LEDs are fixed to have the identical position relationship, the mixing state of colors is sometimes uneven when a mixed light color, for example, an even white is represented. However, the mixing state of colors can be variously adjusted and an even mixed color can be represented by changing the configuration as shown in FIGS. 14 to 18.

The configurations shown in FIGS. 14 to 18 are examples, and the present invention is not limited to these configurations. Though it is preferred to automatically adjust the color correction, means by manual adjustment may be employed.

Additionally, in the present embodiment, light outputs of R, G, and B are changed independently by the mechanistic operation. However, by simultaneously changing the respective current values of LEDs also as in the first to third embodiments, an optimum light color may be set by the current value and the changing means for configuration.

Concrete examples of the mechanistic color correction means mounted on each LED illuminating device will be explained below.

Figure 14:
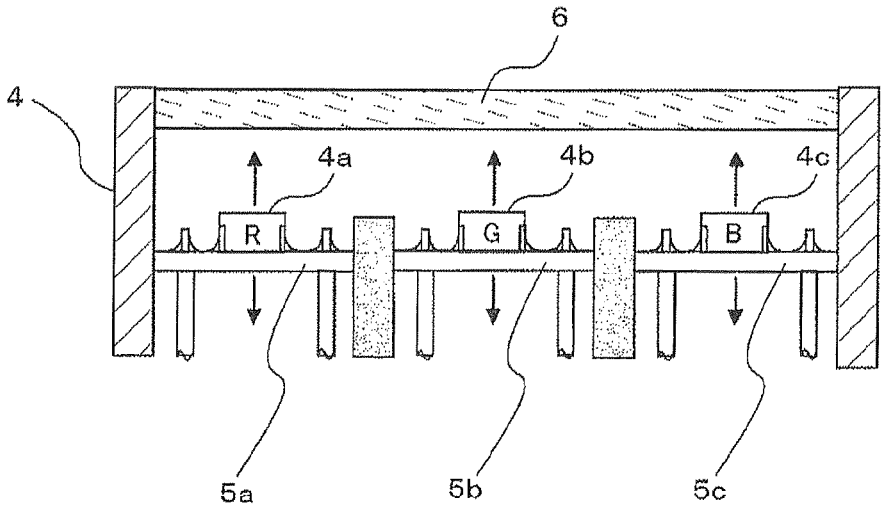
FIG. 14 is a cross-section view showing a first configuration of a LED illuminating device according to a fourth embodiment of the present invention.

The example of FIG. 14 is characterized by including means adapted to adjust the synthetic color of outputted light by individually changing a height of each LED when the LEDs of R, G, and B are housed in one structure.

As shown in FIG. 14, a mechanism in which LEDs 4*a*, 4*b*, and 4*c* of R, G, and B are mounted on individual substrates 5*a*, 5*b*, and 5*c*, respectively, the substrates 5*a*, 5*b*, and 5*c* are incorporated into the rectangular LED unit 4, and the substrates independently move up and down as shown by arrowed lines, respectively is included. Since relative distances from the LEDs 4*a*, 4*b*, and 4*c* to a lens 6 become variable in this manner, transmittance of the lights can be variable. In the case where a predetermined current value passes through each of the LEDs 4*a*, 4*b*, and 4*c* and the respective synthetic light colors are different from predetermined light colors due to the color unevenness of the LEDs of R, G, and B, the synthetic light color of the light output (for example, white) from the LED unit 4 is detected and the individual heights of the LEDs 4*a*, 4*b*, and 4*c* of R, G, and B are automatically or manually adjusted so that a predetermined light color is emitted.

Figure 15:
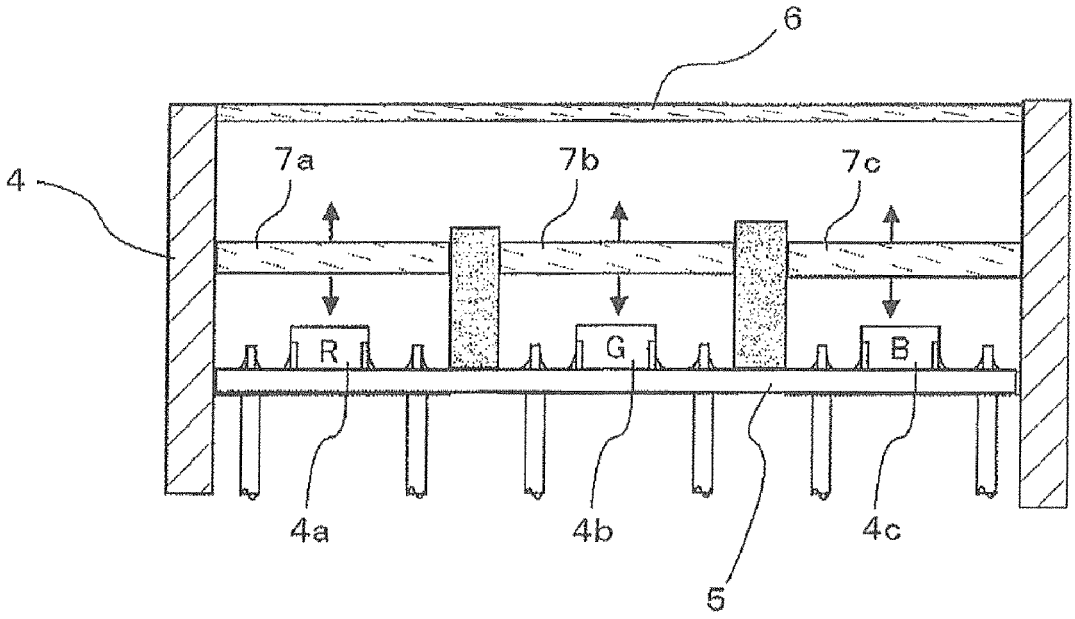
FIG. 15 is a cross-section view showing a second configuration of the LED illuminating device according to the fourth embodiment of the present invention.

The example of FIG. 15 is characterized by including means adapted to adjust the synthetic color of outputted light by individually changing a height of each lens part provided to the LEDs of R, G, and B, respectively.

The LEDs 4*a*, 4*b*, and 4*c* of R, G, and B are mounted on one piece of a rectangular LED substrate 5 as shown in FIG. 15, which is configured so that a predetermined current value can pass through the LEDs 4*a*, 4*b*, and 4*c* of R, G, and B, respectively. A mechanism in which independent lens parts (panel parts) 7*a*, 7*b*, and 7*c* are provided on upper portions of the LEDs 4*a*, 4*b*, and 4*c* of R, G, and B, respectively, and their heights are independently varied up and down as shown by arrowed lines, respectively is included. When the respective synthetic light colors are different from predetermined light colors due to the color unevenness of the LEDs of R, G, and B, the color unevenness of the LEDs 4*a*, 4*b*, and 4*c* of R, G, and B is adjusted to emit a predetermined light color by changing their transmittance through: detection and comparison of the light color with a predetermined light output (for example, white); and adjustment of the individual heights of the LEDs parts (panel parts) 7*a*, 7*b*, and 7*c*.

Figure 16:
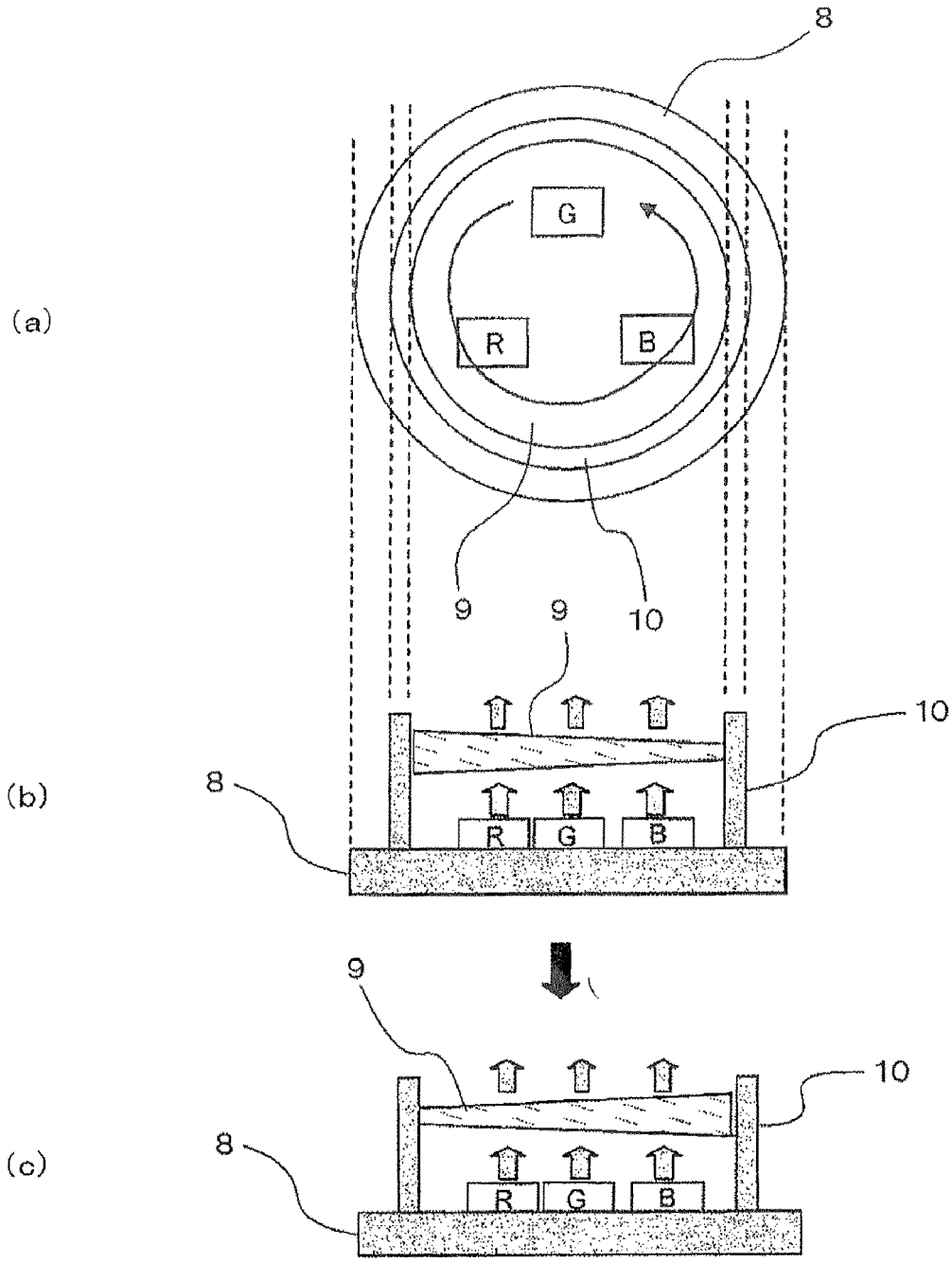
FIG. 16 shows a third configuration of the LED illuminating device according to the fourth embodiment of the present invention, with (a) being a top view and (b) and (c) are cross-section views.

The example of FIG. 16 is characterized in that: a lens part having an uneven thickness is provided to an upper portion of a round-shaped LED unit mounting the LEDs of R, G, and B; and transmittance of lights from the respective LEDs are changed by rotating the lens part.

As shown in FIG. 16(*a*), the LEDs R, G, and B are mounted on a round-shaped substrate 8, which is configured so that a predetermined current value can pass through the LEDs R, G, and B, respectively, and a lens part 9 is provided to their upper portions. A thickness of the lens part 9 is not even, a lens thicknesses at the upper portions of the LEDs of R, G, and B are designed to be different from each other, and the lens part 9 is configured to be able to rotate. In the drawing, the symbol R represents a red LED, the symbol G represents a green LED, the symbol B represents a blue LED, and a number 10 represents a lens frame part.

In the case where the synthetic light color is different from a predetermined light color due to the color unevenness of the LEDs R, G, and B, the synthetic light is adjusted to be the predetermined light color by rotating the lens part 9 to change transmittance of the respective lights of the LEDs of R, G, and B.

FIGS. 16 (*b*) and (*c*) illustrate that each of the lens thicknesses at the upper portions of the LEDs R, G, and B changes when the lens part 9 rotates 180 degrees.

Figure 17:
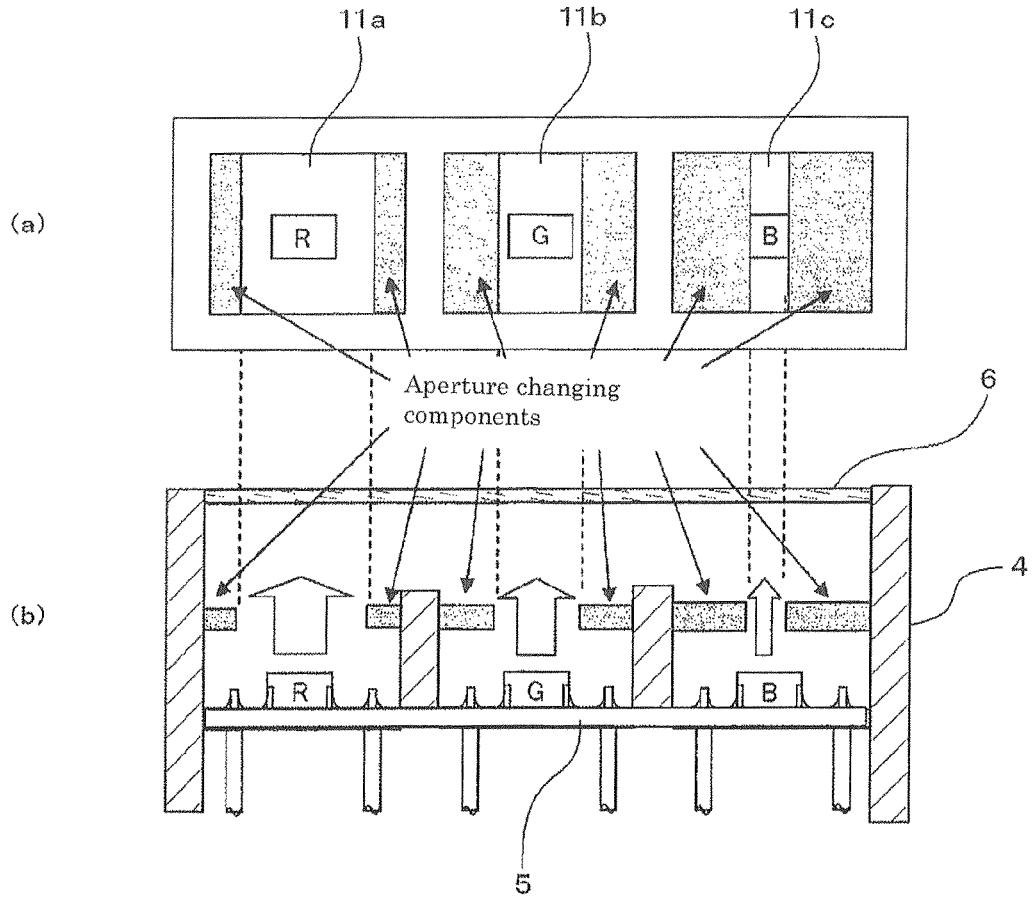
FIG. 17 is shows a fourth configuration of the LED illuminating device according to the fourth embodiment of the present invention, with (a) being a top view and (b) is a cross-section view.

The example of FIG. 17 is characterized in that each of the LEDs R, G, and B is stored in a housing with partitions, and means adapted to change apertures of aperture windows 11*a*, 11*b*, and 11*c* provided to their upper portions is included. In the drawing, the symbol R represents the red LED, the symbol G represents the green LED, and the symbol B represents the blue LED.

As shown in FIG. 17, the LEDs R, G, and B are mounted on the rectangular substrate 5. A structure able to house the LEDs R, G, and B in compartments each individually having a window is employed, and a light color is adjusted by change areas of the aperture windows 11*a*, 11*b*, and 11*c* to change light outputs of the LEDs of R, G, and B, respectively. Similar to the above-mentioned embodiments, when the synthetic light color is different from a predetermined light color due to the color unevenness of the LEDs of R, G, and B, the synthetic light is adjusted to be the predetermined light color by changing the aperture areas of the aperture windows 11*a*, 11*b*, and 11*c* to adjust lights of the LEDs of R, G, and B.

Figure 18:
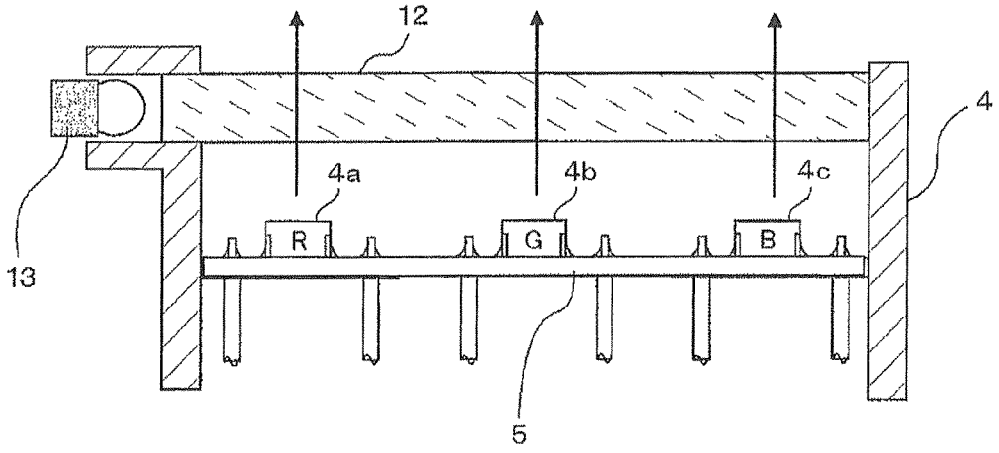
FIG. 18 is a cross-section view showing a fifth configuration of the LED illuminating device according to the fourth embodiment of the present invention.

The example of FIG. 18 is characterized in that a lens part provided at an upper portion of the LEDs R, G, and B as means adapted to adjust an emission amount includes a light guiding plate 12; and a color of the light guiding plate 12 is changed by using a second RGB light source 13 as a light source of the light guiding plate 12.

As shown in FIG. 18, a configuration where the LEDs 4*a*, 4*b*, and 4*c* of R, G, and B are mounted on one piece of the substrate 5; the light guiding plate 12 is arranged at their upper portion; and the second RGB light source 13 is additionally provided to the light guiding plate 12 to change a color of the light guiding plate 12. The second RGB light source 13 is, for example, an RGB bulb. Also in the present example, in the case where the synthetic light color is different from a predetermined light color due to the color unevenness of the LEDs of R, G, and B, the synthetic light is adjusted to be the predetermined light color by: changing a light color of the second RGB light source 13 to change the light color from the light guiding plate 12.

Thus, although there have been described particular embodiments of the present invention of a new and useful LED ILLUMINATING DEVICE it is not intended that such references be construed as limitations upon the scope of this invention except as set forth in the following claims.

What is claimed is:

1. An LED illuminating device comprising: a power source device; a controller; an LED lighting device; and an LED unit incorporating LEDs of a plurality of emission colors and which is configured so as to: mix the lights of the LEDs at an arbitrary proportion; and set the lights in an arbitrary color mixture proportion on the basis of a dimming signal from the controller, wherein the LED illuminating device is configured so that: a coefficient specific to the LED unit at which an emission color of the LED unit becomes a desired color can be set to a signal value of the controller preliminarily set as a standard; and the LED lighting device can control an emission amount of the LEDs having the respective emission colors by using a value calculated by a calculation expression employing the specific coefficient.

2. The LED illuminating device according to claim 1, wherein the LED illuminating device is configured to adjust the emission amount by using values obtained by multiplying a dimming signal from the controller by a coefficient specific to the LED unit.

3. The LED illuminating device according to claim 1, wherein: the LED unit includes at least: a first LED having a first emission color; and a second LED having a second emission color; and a dimming signal from the controller to the first LED is referred to as a first dimming signal and a dimming signal from the controller to the second LED is referred to as a second dimming signal, configured so that:

in a case where both of the first dimming signal and the second dimming signal are dimming signals of a level preliminarily set as a standard, an emission amount of the first LED is adjusted by using a value obtained by multiplying the coefficient specific to the LED unit by the first dimming signal and an emission amount of the second LED is adjusted by using a value obtained by multiplying the coefficient specific to the LED unit by the second dimming signal; and in a case where at least one of the first dimming signal and the second dimming signal is a dimming signal of a lower level than that preliminarily set as a standard value, the emission amount of the first LED is adjusted to be larger than an emission amount represented by the value obtained by multiplying the coefficient specific to the LED unit by the first dimming signal as the second dimming signal becomes smaller than a level preliminarily set as a standard, and the emission amount of the second LED is adjusted to be larger than an emission amount represented by the value obtained by multiplying the coefficient specific to the LED unit by the second dimming signal as the first dimming signal becomes smaller than a level preliminarily set as a standard.

4. The LED illuminating device according to claim 1, wherein: the LED unit comprises a first LED having a first emission color, a second LED having a second emission color, and a third LED having a third emission color; and a dimming signal from the controller to the first LED is referred to as a first dimming signal, a dimming signal from the controller to the second LED is referred to as a second dimming signal, and a dimming signal from the controller to the third LED is referred to as a third dimming signal, configured so that:

in a case where all of the first dimming signal, the second dimming signal, and the third dimming signal are dimming signals of a level preliminarily set as a standard, an emission amount of the first LED is adjusted by using a value obtained by multiplying the coefficient specific to the LED unit by the first dimming signal, an emission amount of the second LED is adjusted by using a value obtained by multiplying the coefficient specific to the LED unit by the second dimming signal, and an emission amount of the third LED is adjusted by using a value obtained by multiplying the coefficient specific to the LED unit by the third dimming signal; and in a case where at least one of the first dimming signal, the second dimming signal, and the third dimming signal is a dimming signal of a lower level than that preliminarily set as a standard, the emission amount of the first LED is adjusted to be larger than an emission amount represented by the value obtained by multiplying the coefficient specific to the LED unit by the first dimming signal as the second dimming signal or the third dimming signal becomes smaller than a level preliminarily set as a standard, the emission amount of the second LED is adjusted to be larger than an emission amount represented by the value obtained by multiplying the coefficient specific to the LED unit by the second dimming signal as the first dimming signal or the third dimming signal becomes smaller than a level preliminarily set as a standard, and the emission amount of the third LED is adjusted to be larger than an emission amount represented by the value obtained by multiplying the coefficient specific to the LED unit by the third dimming signal as the first dimming signal or the second dimming signal becomes smaller than a level preliminarily set as a standard.

5. The LED illuminating device according to claim 4 configured so that: in the case where at least one of the first dimming signal, the second dimming signal, and the third dimming signal is a dimming signal of a lower level than that preliminarily set as a standard value, the emission amount of the first LED is adjusted to be larger than an emission amount represented by the value obtained by multiplying the coefficient specific to the LED unit by the first dimming signal as a larger one of the dimming signal levels of the second dimming signal and the third dimming signal becomes smaller than a level preliminarily set as a standard value, the emission amount of the second LED is adjusted to be larger than an emission amount represented by the value obtained by multiplying the coefficient specific to the LED unit by the second dimming signal as a larger one of the dimming signal levels of the first dimming signal and the third dimming signal becomes smaller than a level preliminarily set as a standard, and the emission amount of the third LED is adjusted to be larger than an emission amount represented by the value obtained by multiplying the coefficient specific to the LED unit by the third dimming signal as a larger one of the dimming signal levels of the first dimming signal and the second dimming signal becomes smaller than a level preliminarily set as a standard.

6. The LED illuminating device according to claim 4 configured so that:in the case where at least one of the first dimming signal, the second dimming signal, and the third dimming signal is a dimming signal of a lower level than that preliminarily set as a standard, the emission amount of the first LED is adjusted to be larger than an emission amount represented by the value obtained by multiplying the coefficient specific to the LED unit by the first dimming signal as the product of a dimming amount of light of the second dimming signal and a dimming amount of light of the third dimming signal becomes larger, the emission amount of the second LED is adjusted to be larger than an emission amount represented by the value obtained by multiplying the coefficient specific to the LED unit by the second dimming signal as the product of a dimming amount of light of the first dimming signal and a dimming amount of light of the third dimming signal becomes larger, and the emission amount of the third LED is adjusted to be larger than an emission amount represented by the value obtained by multiplying the coefficient specific to the LED unit by the third dimming signal as the product of a dimming amount of light of the first dimming signal and a dimming amount of light of the second dimming signal becomes larger.

7. The LED illuminating device according to one of claims 1 to 6, wherein the LED unit incorporating LEDs of a plurality of emission colors includes a mechanistic part for individually adjusting the emission amounts of the respective LEDs so that the emission color can be a desired color.

* * * * *